US006241238B1

(12) United States Patent
Aoki

(10) Patent No.: US 6,241,238 B1
(45) Date of Patent: Jun. 5, 2001

(54) SHEET-LIKE MATERIAL GUIDING DEVICE OF OFFSET PRINTING PRESS

(75) Inventor: Takanobu Aoki, Toride (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/397,027

(22) Filed: Sep. 16, 1999

(30) Foreign Application Priority Data

Sep. 18, 1998 (JP) ..... 10-264118

(51) Int. Cl.[7] ..... B65H 29/68
(52) U.S. Cl. ..... 271/183; 271/200; 271/204
(58) Field of Search ..... 271/182, 183, 271/191, 204, 207, 196, 200

(56) References Cited

U.S. PATENT DOCUMENTS

| | | | | |
|---|---|---|---|---|
| 3,167,012 | * | 1/1965 | Claybourn | 271/201 |
| 3,730,517 | * | 5/1973 | Norton | 271/204 |
| 3,960,374 | * | 6/1976 | Gaffney | 271/204 |
| 4,469,321 | * | 9/1984 | Geschwindner | 271/204 |
| 4,830,355 | | 5/1989 | Jeschke . | |
| 5,259,608 | * | 11/1993 | Pollich | 271/204 |
| 5,263,415 | * | 11/1993 | Pollich | 271/204 |

FOREIGN PATENT DOCUMENTS

| | | |
|---|---|---|
| 3638322A1 | 11/1987 | (DE) . |
| 1592001 | 5/1970 | (FR) . |
| 4-211943 | 8/1992 | (JP) . |

* cited by examiner

*Primary Examiner*—H. Grant Skaggs

(57) ABSTRACT

A sheet-like material guiding device of an offset printing press comprises a chain for holding and transporting a printed sheet; a product pile device for piling the printed sheet released from the chain; a suction device for reducing the speed of the printed sheet transported by the chain, the suction device being supported movably in the direction of transport of the printed sheet; and a belt disposed below the chain for guiding the printed sheet at nearly the same speed as the speed of transport of the printed sheet by the chain, the belt being movable so as to follow the movement of the suction device, the sheet-like material guiding device including a pair of driven rollers for supporting the belt, and a chain for supporting the driven rollers movably, with the distance between the driven rollers being unchanged. The belt can satisfactorily follow during movement of the suction device to achieve smooth transport, and a drive source for the suction device can be made small in capacity.

5 Claims, 7 Drawing Sheets

SHEET-LIKE MATERIAL GUIDING DEVICE OF OFFSET PRINTING PRESS

BACKGROUND OF THE INVENTION

1. Field of the Invention

The present invention relates to a sheet-like material guiding device of an offset printing press.

2. Description of the Related Art

This type of device is disclosed, for example, in Japanese Unexamined Patent Publication No.4-211943. This publication discloses a sheet-fed offset printing press which delivers a printed sheet from a printing unit to a sheet pile device through a delivery passage defined between a chain towing transport mechanism and a transport guide mechanism; wherein the transport guide mechanism is composed of a transport belt (tape) extending in a direction of transport (circumferential direction), and being revolvingly driven in synchronism with the chain towing transport mechanism. The transport belt is connected to a suction wheel (vacuum wheel), and is movable in the transport direction in a manner interlocked with the suction wheel which is movable in the transport direction in accordance with a change in paper size. Elimination of loosening of the transport belt during its motion toward a loose side has been performed by a plumb bob interposed halfway in a looping of the transport belt.

As described above, while the transport belt is moving toward a loose side during the movement of the suction wheel, elimination of loosening of the transport belt has been performed by a plumb bob interposed halfway in a looping of the transport belt. As a result, the tension of the transport belt becomes, as such, a load on the movement of the suction wheel. Thus, a great power is required for the movement of the suction wheel. That is, a power source enough powerful to overcome the weight of the plumb bob is needed, thereby inducing a cost increase. Furthermore, during the movement of the suction wheel, the transport belt may be stretched by the plumb bob, causing a change in the tension. If the plumb bob happens to be inclined, the transport belt may be loosened.

SUMMARY OF THE INVENTION

The present invention has been accomplished in view of the above-described problems. It is an object of the invention to provide a sheet-like material guiding device of an offset printing press in which a guide means can satisfactorily follow during the movement of a sheet speed reducing means to achieve smooth transport, and in which a drive source for the sheet speed reducing means can be made small in capacity.

To attain the above object, the present invention claims a sheet-like material guiding device of an offset printing press, comprising:

- a transport means for holding and transporting a sheet-like material;
- a sheet piling means for piling the sheet-like material released from the transport means;
- a sheet speed reducing means for reducing a speed of the sheet-like material transported by the transport means, the sheet speed reducing means being supported movably in a direction of transport of the sheet-like material; and
- a guide means disposed below the transport means for guiding the sheet-like material at nearly the same speed as a speed of transport of the sheet-like material by the transport means, the guide means being movable so as to follow movement of the sheet speed reducing means, the sheet-like material guiding device including

- a pair of rotating parts for supporting the guide means, and
- a moving member for supporting the rotating parts movably, with the distance between the rotating parts being unchanged.

The guide means may be a belt enough wide to cover a maximum sheet size.

The guide means may also be a belt, and may be formed by coating urethane onto an upper surface of a cloth comprising warp and weft of polyester, and impregnating a lower surface of the cloth with urethane.

The guide means may also be a belt looped over a plurality of rollers. The pair of rotating parts may be two rollers movably supported by brackets among the plurality of rollers. One of the brackets for the two rollers may be connected to a suction device as the sheet speed reducing means, and the brackets for the two rollers may be connected together via a chain as the moving member movable along a bent chain guide.

The guide means may also be a belt looped between two rollers as the pair of rotating parts movably supported by brackets; one of the brackets for the two rollers may be connected to a suction device as the sheet speed reducing means, and the brackets for the two rollers may be connected together via a rod-shaped part as the moving member.

According to the foregoing constitutions, during the movement of the sheet speed reducing means, the guide means can satisfactorily follow, without imposing a load on a drive source for the sheet speed reducing means. Thus, smooth transport can be realized, and the drive source for the sheet speed reducing means can be made small incapacity. Besides, when the chain movable along the bent chain guide is used, the belt can be caused to effectively follow the suction device, without involving interference with other materials or an increase in space.

The present invention is preferred for use in a sheet-fed offset printing press.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENTS OF THE INVENTION

A sheet-like material guiding device of an offset printing press according to the present invention will now be described in detail by way of embodiments with reference to the accompanying drawings.

[First Embodiment]

Figure 1:
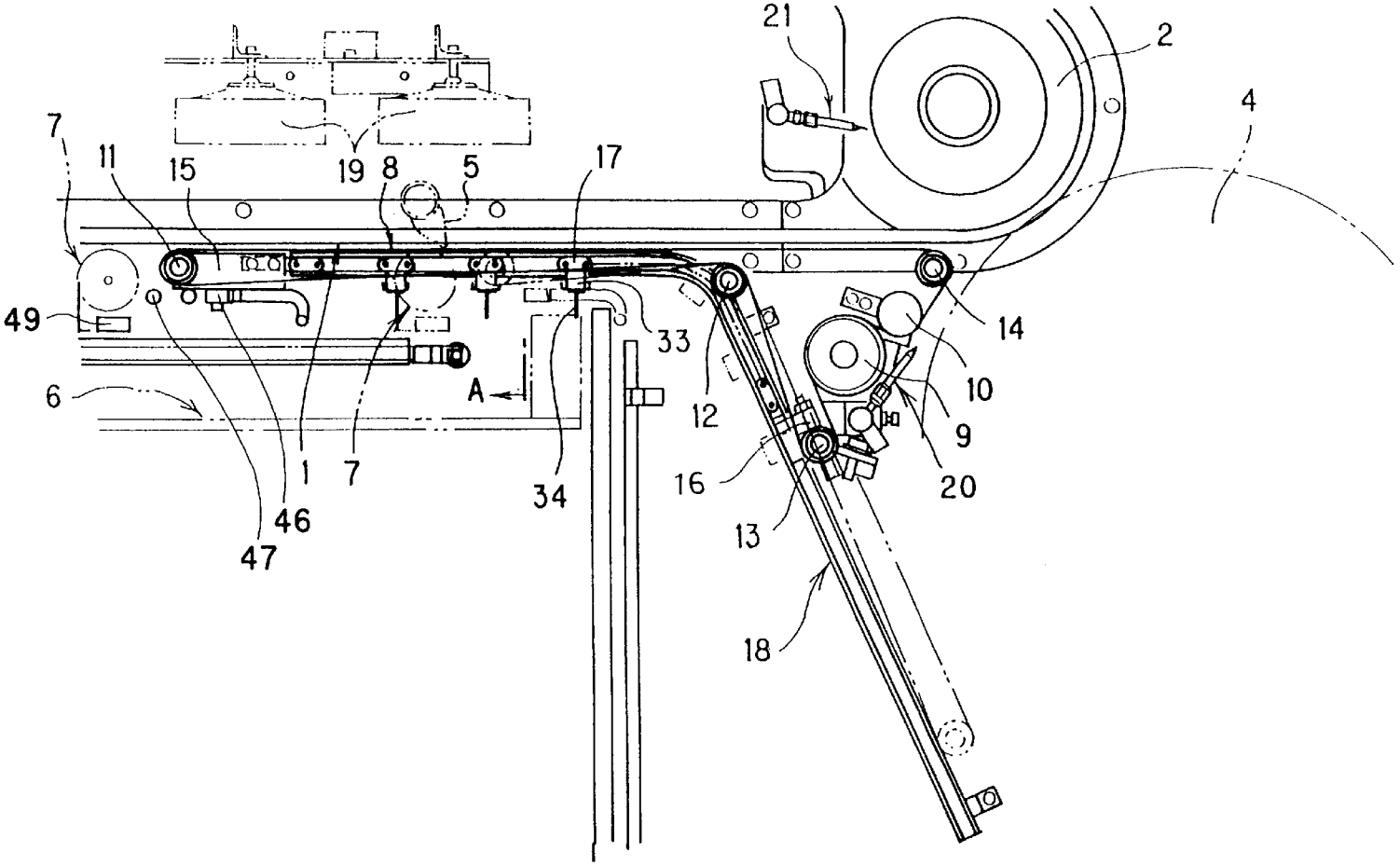
FIG. 1 is a side view of a sheet-like material guiding device of a sheet-fed offset printing press showing a first embodiment of the present invention.
Figure 2:
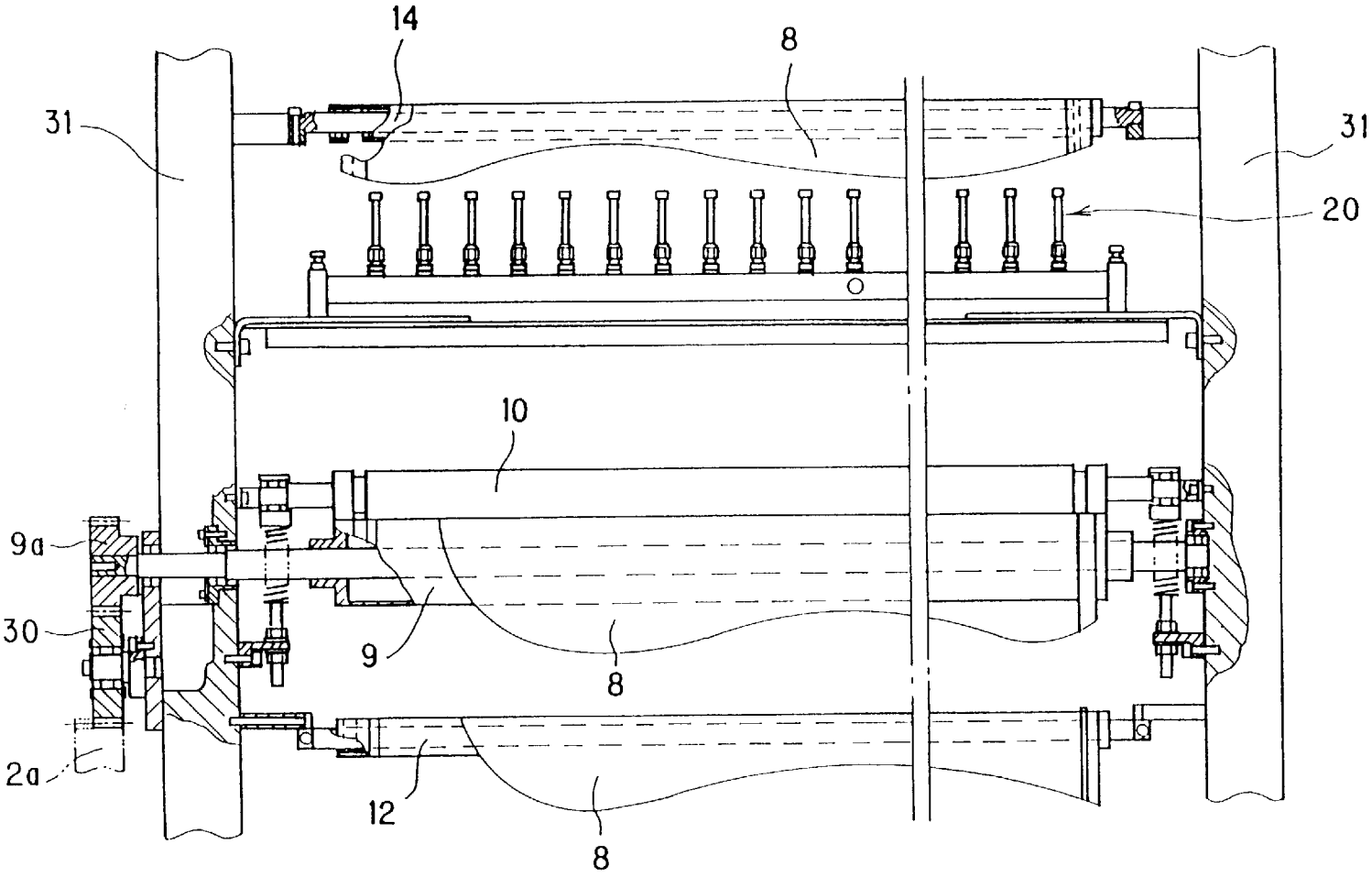
FIG. 2 is a development plan view of an essential part of the sheet-like material guiding device.
Figure 3:
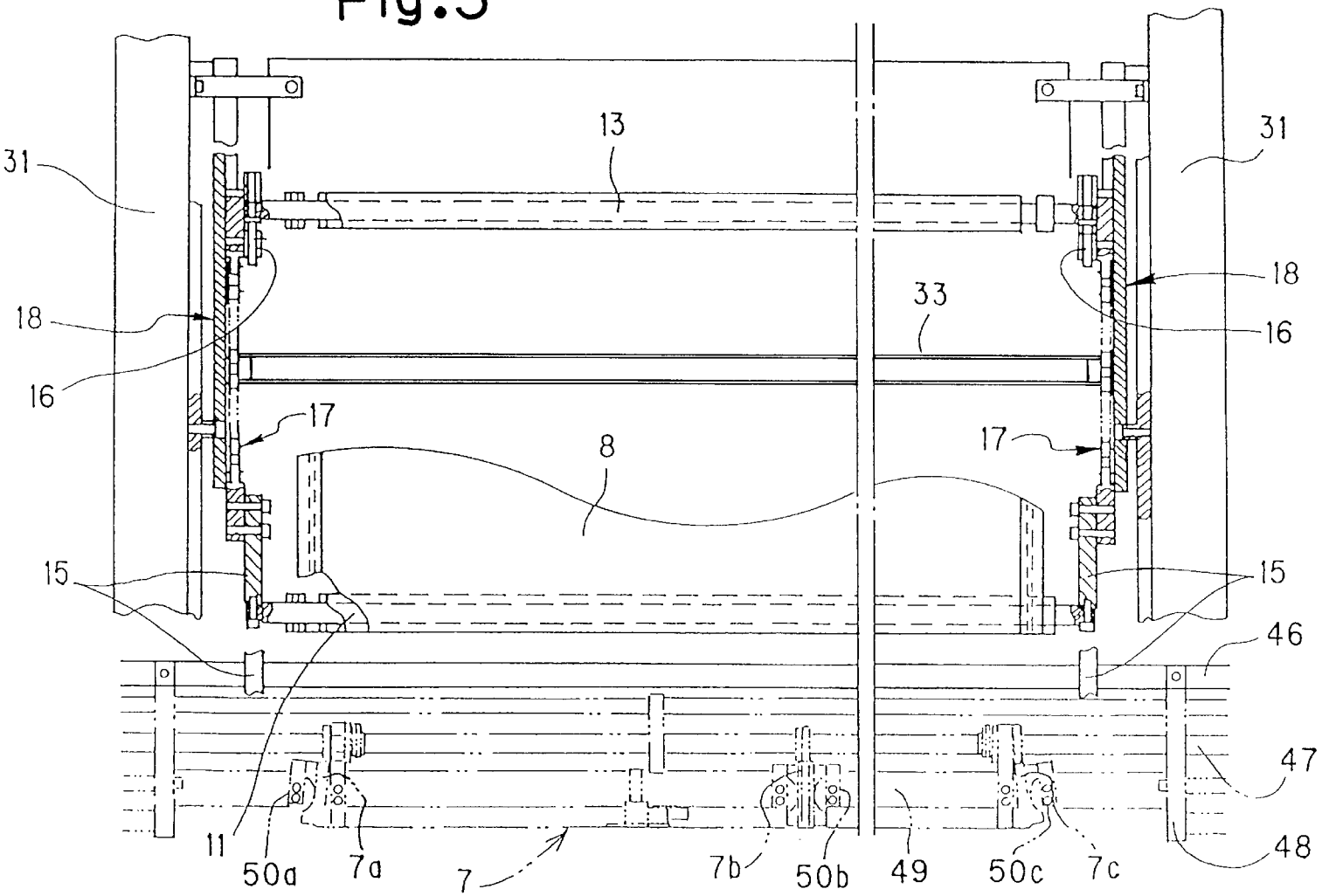
FIG. 3 is a development plan view of a different essential part of the sheet-like material guiding device.
Figure 4:
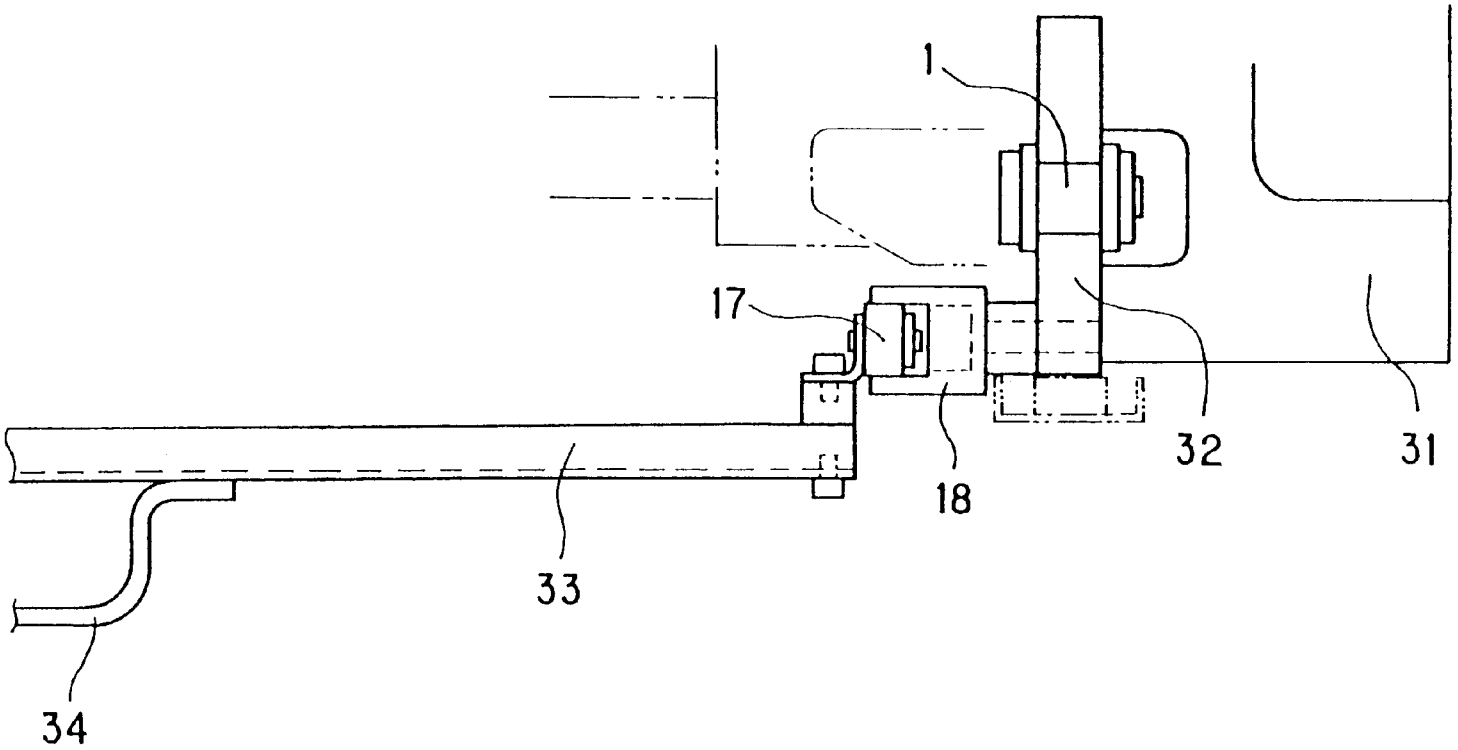
FIG. 4 is a sectional view taken along line A in FIG. 1.
Figure 5:
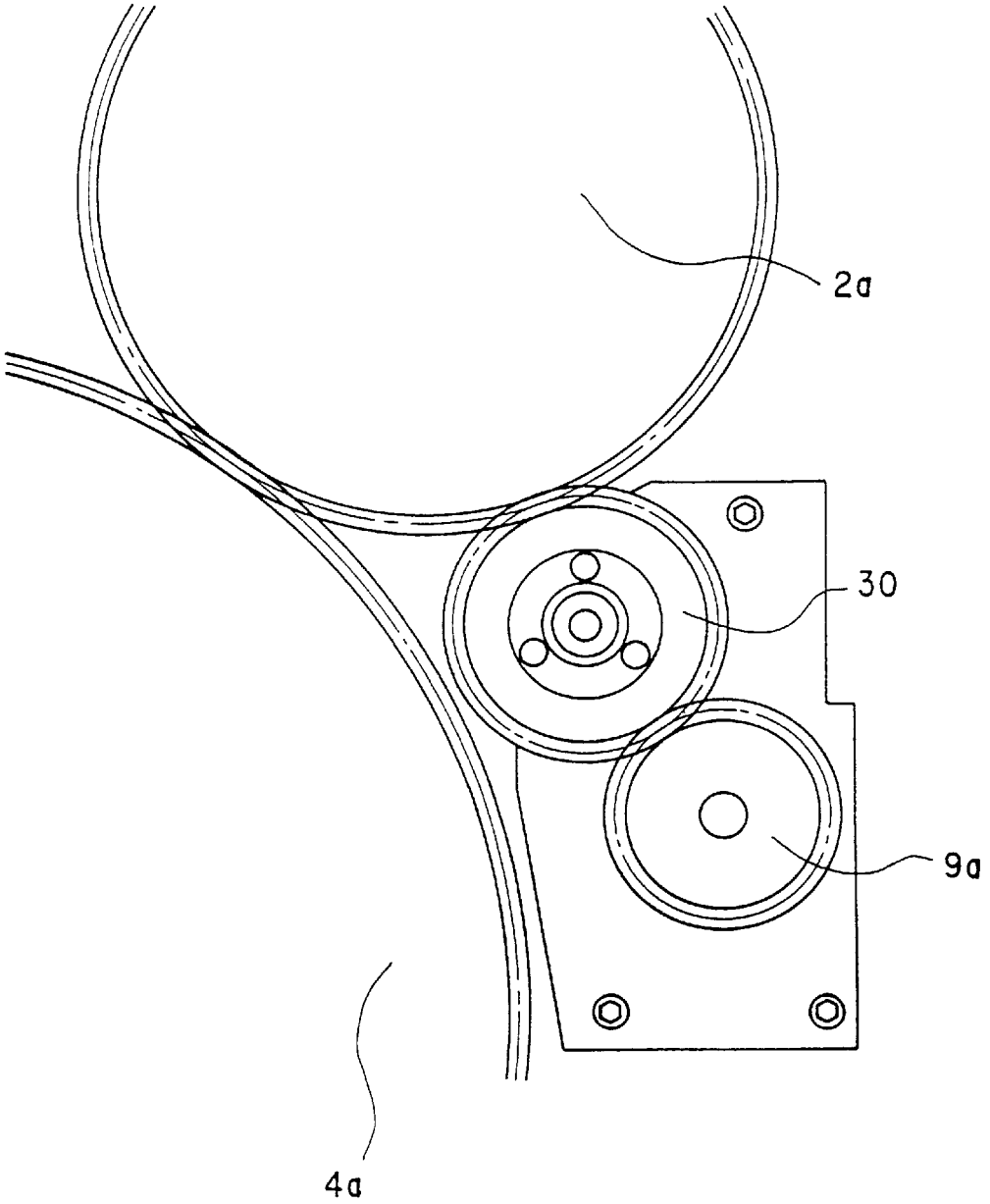
FIG. 5 is an external view on a drive side of the sheet-like material guiding device.
Figure 6:
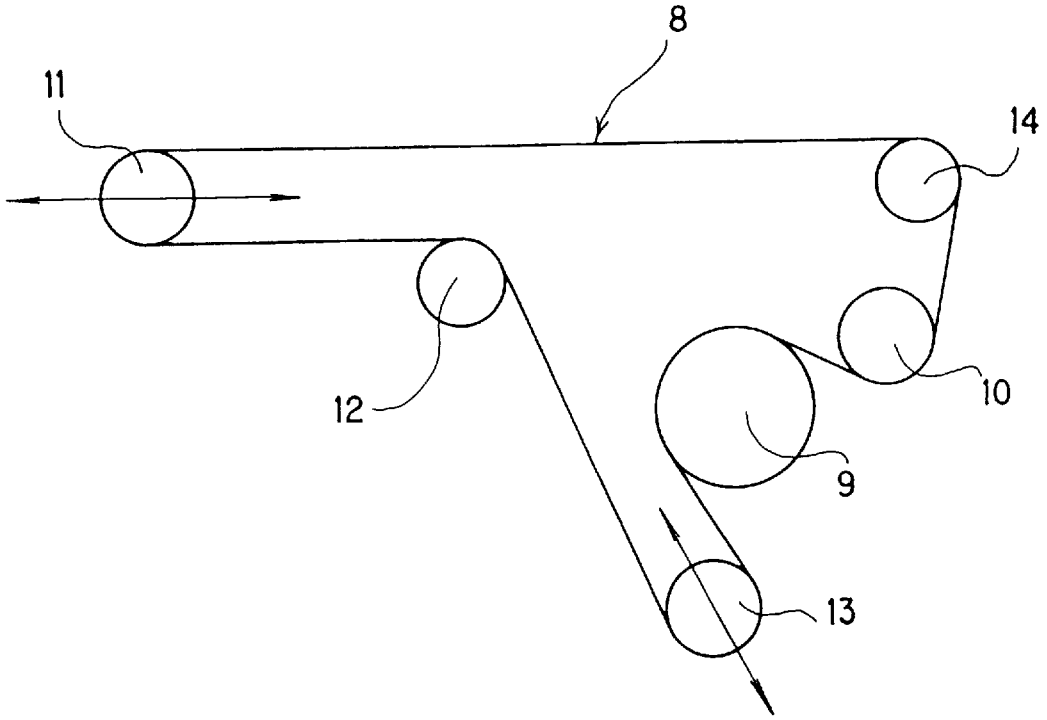
FIG. 6 is a schematic view of looping of a belt.

FIG. 1 is a side view of a sheet-like material guiding device of a sheet-fed offset printing press showing a first embodiment of the present invention. FIG. 2 is a development plan view of an essential part of the sheet-like material guiding device. FIG. 3 is a development plan view of a different essential part of the sheet-like material guiding device. FIG. 4 is a sectional view taken along line A in FIG. 1. FIG. 5 is an external view on a drive side of the sheet-like material guiding device. FIG. 6 is a schematic view of looping of a belt.

As shown in FIG. 1, a chain 1 as a transport means is looped between a pair of (i.e., front and rear) sprockets 2, and revolvingly driven. On the chain 1, a plurality of grippers 5 for receiving a printed sheet as a sheet-like material from a sheet transport cylinder 4 are provided in a direction of sheet width. These grippers 5 are arranged with constant spacing in a longitudinal direction of the chain 1.

The printed sheet held by the grippers 5 is transported to a site above a product pile device 6 as a sheet piling means in accordance with the travel of the chain 1. At this site, the printed sheet is released from gripping by the grippers 5 under the action of a cam mechanism (not shown), and piled onto the product pile device 6. At this time, the speed of the printed sheet is decreased by a suction device 7 as a sheet speed reducing means which has a plurality of (three in the drawing) suction wheels, i.e., suction wheels 7*a*, 7*b*, 7*c*, in the sheet width direction that have suction surfaces and that are rotationally driven at a slightly lower peripheral speed than a travel speed of the chain 1.

A belt 8 as a guide means for guiding the printed sheet transported by the grippers 5 is provided below the chain 1. This belt 8, as shown in FIG. 6, is looped over six rollers as rotating parts, i.e., a drive roller 9, a tension roller 10, and driven rollers 11 to 14. The belt 8 is supported, parallel to the chain 1, in a sheet guide region between the driven rollers 11 and 14, and the belt 8 travels at nearly the same speed as the travel speed of the chain 1.

As shown in FIG. 5, a drive gear 9*a* of the drive roller 9 receives power transmitted from a power side of the machine via an intermediate gear 30, a drive gear 2*a* of the sprocket 2, and a drive gear 4*a* of the sheet transport cylinder 4.

Brackets 15 supporting the driven roller 11 are connected to the suction device 7 that moves in the sheet transport direction as the paper size is changed. In accordance with the movement of the suction device 7, the driven roller 11 also moves in the sheet transport direction. In detail, a stay bar 46 is fixed to a lower end of the bracket 15. To this stay bar 46, a support member 48 is fixed for rotatably supporting a drive shaft 47 which drives the suction wheels 7*a*, 7*b*, 7*c*. The suction wheels 7*a*, 7*b*, 7*c* are supported by a stay bar 49 via brackets 50*a*, 50*b*, 50*c* which rotatably support the suction wheels 7*a*, 7*b*, 7*c*. The stay bar 46, drive shaft 47, and stay bar 49 are supported by right and left frames (not shown).

The driven rollers 11 and 13 are connected together so that as the driven roller 11 moves, the driven roller 13 also moves. That is, to the brackets 15 supporting the driven roller 11, and to brackets 16 supporting the driven roller 13, ends of a chain 17 as a moving member are connected and fixed. The chain 17, as shown in FIG. 4, is guided by a chain guide 18 fixed to a machine frame 31. In FIG. 4, the reference numeral 32 denotes a chain guide for the chain 1, 33 denotes a member for regulating the right and left chains 17, and 34 denotes a member for guiding a vacuum hose (not shown) of the suction device 7.

The belt 8 is a belt enough wide to cover a maximum sheet size, and is formed by coating urethane onto an upper surface of a cloth comprising warp and weft of polyester, and impregnating a lower surface of the cloth with urethane, as surface treatment for minimal reception of ink. The temperature at which the belt is used ranges from −10° C. to 100° C., and in the present embodiment, the belt is used at room temperature.

Above the product pile device 6, a plurality of fans 19 are provided for dropping the printed sheet, released from gripping by the grippers 5, onto the product pile device 6.

In FIG. 1, the reference numeral 20 denotes an air nozzle for blowing a lower surface of the printed sheet, which is transported by the grippers 5, to prevent the printed sheet from sagging in a region between the driven roller 14 and the sheet transport cylinder 4 (the region where the printed sheet is not guided by the belt 8). The reference numeral 21 denotes an air nozzle for blowing an upper surface of the printed sheet, which is transported by the grippers 5, to press the printed sheet against the circumferential surface of the sheet transport cylinder 4.

Because of the foregoing constitution, the printed sheet, which has been received by the grippers 5 of the chain 1 from the sheet transport cylinder 4, has an underside guided by the belt 8 traveling at nearly the same speed as the travel speed of the chain 1. As a result, the printed sheet is transported to a site above the product pile device 6. At the site, the printed sheet is released from gripping by the grippers 5, and decreased in speed by the suction device 7, and finally piled onto the produce pile device 6.

In the present embodiment, fluttering, etc. of a trailing edge of the printed sheet are prevented by the belt 8, and thus the printed sheet is smoothly transported by the belt 8. Needless to say, the belt 8 travels at nearly the same speed as does the chain 1, so that there are no scratches of the printed sheet against the belt 8.

When the suction device 7 is moved in the transport direction by a drive source (not shown) in response to a change in paper size, the front driven roller 11 connected to the suction device 7 also moves in the same direction. The rear driven roller 13 also moves following the front driven roller 11, since it is connected to the front driven roller 11 via the chains 17. During these actions, little change is given to the track length of the belt 8 by the movement of the two rollers 11 and 13, so that the belt tension is unchanged.

According to the present embodiment, as described above, during the movement of the suction device 7, the belt 8 can satisfactorily follow, without imposing a load on the drive source for the suction device 7. Thus, smooth transport can be realized, and the drive source for the suction device 7 can be made small in capacity. Besides, the chain 17 is movable along the chain guide 18 having an obliquely downwardly bent latter half portion. Thus, the belt 8 can be caused to effectively follow the suction device 7, without involving interference with other materials or an increase in space.

[Second Embodiment]

Figure 7:
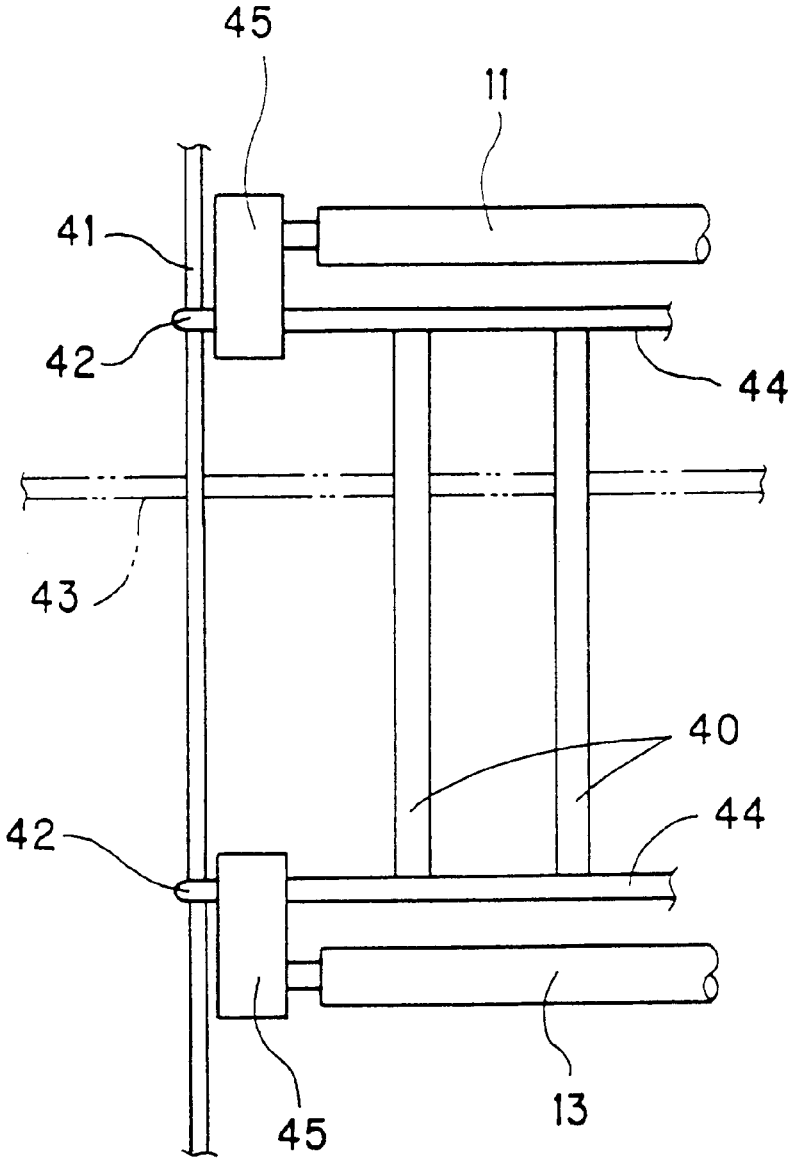
FIG. 7 is a plan view of an essential part of a sheet-like material guiding device of a sheet-fed offset printing press showing a second embodiment of the present invention.

FIG. 7 is a plan view of an essential part of a sheet-like material guiding device of a sheet-fed offset printing press showing a second embodiment of the present invention. This is an embodiment in which when the chain guide 18, etc. in the preceding first embodiment can take a straight path, a plurality of rod-shaped parts 40 for supporting the two rollers 11 and 13 are provided, and the movement of pins 42 is guided by a straight longitudinal guide 41, or the movement of the rod-shaped parts 40 is guided by a transverse guide 43. This embodiment obtains the same actions and effects as those in the first embodiment. The reference numeral 44 denotes a stay bar, and 45 denotes a bracket for supporting the roller 11 or 13.

This invention being thus described, it will be obvious that the same is not restricted to the above-described embodiments, but may be varied in many ways. For example, a string-like material may be used instead of the belt 8 as the guide means. Such variations are not to be regarded as a departure from the spirit and scope of the invention, and all such modifications as would be obvious to one skilled in the art are intended to be included within the scope of the following claims.

What is claimed is:

1. A sheet-like material guiding device of an offset printing press, comprising:

a transport means for holding and transporting a sheet-like material;

a sheet piling means for piling said sheet-like material released from said transport means;

a sheet speed reducing means for reducing a speed of said sheet-like material transported by said transport means, said sheet speed reducing means being supported movably in a direction of transport of said sheet-like material; and a guide means disposed below said transport means for guiding said sheet-like material at nearly the same speed as a speed of transport of said sheet-like material by said transport means, said guide means being movable so as to follow movement of said sheet speed reducing means, said sheet-like material guiding device including a pair of rotating parts for supporting said guide means, and a moving member for supporting said rotating parts movably, with the distance between said rotating parts being unchanged.

2. A sheet-like material guiding device of an offset printing press, as claimed in claim 1, wherein said guide means is a belt enough wide to cover a maximum sheet size.

3. A sheet-like material guiding device of an offset printing press, as claimed in claim 1, wherein said guide means is a belt, and is formed by coating urethane onto an upper surface of a cloth comprising warp and weft of polyester, and impregnating a lower surface of the cloth with urethane.

4. A sheet-like material guiding device of an offset printing press, as claimed in claim 1, wherein said guide means is a belt looped over a plurality of rollers; the pair of rotating parts are two rollers movably supported by brackets among said plurality of rollers; one of the brackets for said two rollers is connected to a suction device as the sheet speed reducing means, and said brackets for said two rollers are connected together via a chain as said moving member movable along a bent chain guide.

5. A sheet-like material guiding device of an offset printing press, as claimed in claim 1, wherein said guide means is a belt looped between two rollers as said pair of rotating parts movably supported by brackets; one of said brackets for said two rollers is connected to a suction device as said sheet speed reducing means, and said brackets for said two rollers are connected together via a rod-shaped part as said moving member.

* * * * *